US007331696B2

(12) United States Patent
Rupert et al.

(10) Patent No.: US 7,331,696 B2
(45) Date of Patent: Feb. 19, 2008

(54) METHOD AND APPARATUS FOR MOUNTING A TASK LIGHT

(75) Inventors: Brian Rupert, Kendallville, IN (US); Geza T. Lanczy, Auburn, IN (US); Tim Culbertson, Fort Wayne, IN (US); Gregg Laukhuf, Bryan, OH (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 11/284,152

(22) Filed: Nov. 21, 2005

(65) Prior Publication Data

US 2006/0109665 A1 May 25, 2006

Related U.S. Application Data

(60) Provisional application No. 60/630,014, filed on Nov. 22, 2004.

(51) Int. Cl.
*F21S 19/00* (2006.01)

(52) U.S. Cl. ..... 362/382; 362/127; 362/133; 362/362; 292/19

(58) Field of Classification Search ..... 362/382, 362/127, 133, 362, 368; 292/18, 19, 80, 292/87, 218
See application file for complete search history.

(56) References Cited

U.S. PATENT DOCUMENTS

| | | | | |
|---|---|---|---|---|
| 4,454,569 | A * | 6/1984 | Maguire | 362/127 |
| 4,475,311 | A * | 10/1984 | Gibson | 49/176 |
| 4,941,071 | A * | 7/1990 | Knauf | 362/133 |
| 5,079,680 | A | 1/1992 | Kohn | 362/127 |
| 5,226,719 | A | 7/1993 | Feldpausch et al. | 362/133 |
| 5,530,628 | A | 6/1996 | Ngai | 362/33 |
| 5,607,225 | A * | 3/1997 | Halvatzis | 362/125 |
| 5,626,084 | A | 5/1997 | Kelly et al. | 108/23 |
| 5,984,486 | A | 11/1999 | Munz et al. | 362/33 |
| 6,231,205 | B1 | 5/2001 | Slesinger et al. | 362/133 |
| 2002/0191400 | A1 | 12/2002 | Jilk et al. | 362/257 |

FOREIGN PATENT DOCUMENTS

| | | | |
|---|---|---|---|
| JP | 04180713 | 6/1992 | 362/127 |

* cited by examiner

*Primary Examiner*—Ali Alavi
*Assistant Examiner*—Evan Dzierzynski
(74) *Attorney, Agent, or Firm*—Taylor & Aust, P.C.

(57) ABSTRACT

A light fixture for mounting to the underside of a furniture element. The light fixture includes a housing with a first side and a second side opposed to and approximately parallel with the first side. The first side has a first spring latch at one end of the first side and the second side has a second spring latch at one end of the second side. A light source is carried by the housing.

18 Claims, 14 Drawing Sheets

METHOD AND APPARATUS FOR MOUNTING A TASK LIGHT

CROSS REFERENCE TO RELATED APPLICATIONS

This is a non-provisional application based upon U.S. provisional patent application Ser. No. 60/630,014, entitled "METHOD OF MOUNTING A TASK LIGHT", filed Nov. 22, 2004.

BACKGROUND OF THE INVENTION

1. Field of the Invention

The present invention relates to light fixtures, and, more particularly, to light fixtures which are mounted on an underside of a furniture element, for example.

2. Description of the Related Art

Light fixtures are known which mount to the underside of a furniture element such as the underside of a shelf or cabinet. Such a light can then illuminate a worksurface, and may therefore be referred to as a task light. Typically, such light fixtures are mounted to the furniture element by way of fasteners such as screws. A screw hole template is required in order to accurately drill screw holes in the furniture element which match the corresponding mounting hole pattern in the light fixture. After the holes are drilled, the light fixture must be held to the underside of the furniture element so that the screws can be inserted through the mounting holes and screwed into the underside of the furniture element. This process is difficult at best, particularly for a single person, in that it is difficult to both hold the light fixture in place and screw the fasteners. The mounting process can be even more difficult in that there may be not enough vertical space available between the worksurface and the underside of the furniture element to easily use an electric screwdriver. In general, the process of mounting such a task light can be difficult for a single installer, time consuming and tedious. Further, repair of such a fixture may require dismounting the light fixture as access to the side of the light fixture which is adjacent to the underside of the furniture element may be necessary in order to repair the light fixture. Remounting of the light fixture, although not requiring redrilling of the mounting holes, nonetheless has most of the disadvantages of the original mounting process.

A light fixture is known with a mounting arrangement for the light fixture in overhead cabinets and the like which is adapted to removably mount to a light fixture in an overhead storage unit, or cabinet of a modular furniture. However, this fixture requires fairly complex fasteners which mate with legs which are mounted to the furniture. The fasteners have components which can easily break during the installation of the light fixture. The components of the fasteners snap together with components of the corresponding mating legs, and a slight misalignment of the fixture relative to the legs causes interferences, which if forced, can result in fracture of the components. A further disadvantage is that the furniture needs to be modified by the installation of the mating legs. A further disadvantage is that the relatively fragile fasteners and legs can be damaged during shipping or other handling such as installation.

A shelf and light module assembly which includes mounting slots formed in the sides of the light module which mate with corresponding and projecting members. Disadvantages of this design include that the slots reduce the strength of the light module assembly, and require an additional machining or punching operation, and alignment with the projecting members. Other disadvantages include that the light is not self-supporting during the installation process and therefore is not easily mounted or dismounted, and the projecting members can easily be broken off if the slot is misaligned.

What is needed in the art is a method and apparatus for mounting a light fixture to the underside of a furniture element, which is cost effective to manufacture, which allows easy installation and repair of the light fixture, which is reliable in service and which resists shipping damage.

SUMMARY OF THE INVENTION

The present invention provides a light fixture with a side which can be rotatably mounted to an underside of a furniture element, and which can be rotated toward the furniture element to conclude mounting of the light fixture by springing latches of the light fixture to a supported position on a ledge of the furniture element.

The invention comprises, in one form thereof, a light fixture for mounting to the underside of a furniture element. The light fixture includes a housing with a first side and a second side opposed to and approximately parallel with the first side. The first side has a first spring latch at one end of the first side and the second side has a second spring latch at one end of the second side. A light source is carried by the housing.

The invention comprises, in another form thereof, a furniture assembly which includes a furniture element with an underside, and a light fixture mounted to the underside of the furniture element. The light fixture includes a housing with a first side and a second side opposed to and approximately parallel with the first side. The first side has a first spring latch at one end of the first side and the second side has a second spring latch at one end of the second side. A light source is carried by the housing.

The invention comprises, in another form thereof, a method of assembling a light fixture to a furniture assembly, including the steps of: providing a furniture element including an underside with at least one ledge; providing a light fixture including: a housing including a first side and a second side opposed to and approximately parallel with the first side, the first side having a first spring latch at one end of the first side and the second side having a second spring latch at one end of the second side, and a light source carried by the housing, the first side including a first hook at an opposite end of the first side, the second side including a second hook at an opposite end of the second side; hooking the first hook and the second hook to the furniture element; rotating the light fixture toward the underside; resiliently deforming inwardly both the first spring latch and the second spring latch; releasing both the first spring latch and the second spring latch; and resting both the first spring and the second spring latch on a respective ledge.

An advantage of the present invention is that it provides a method and apparatus for mounting a light fixture to the underside of a furniture element which allows relatively easy installation of the light fixture.

Another advantage of the present invention is that it allows for easy repair of the light fixture.

Yet another advantage of the present invention is that it is cost effective to manufacture.

Yet another advantage is that the light fixture of the present invention is reliable in service.

Yet another advantage of the present invention is that it resists shipping damage.

Yet another advantage of the present invention is that it does not requiring drilling of mounting holes in the furniture.

Yet another advantage of the light fixture according to the present invention is that it is self-supporting during the installation process.

Yet another advantage of the light fixture according to the present invention is that it can be easily installed by a single person.

Yet another advantage of the light fixture according to the present invention is that it can support itself during the installation and thereby provide strain relief of the electrical wires during electrical connection.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
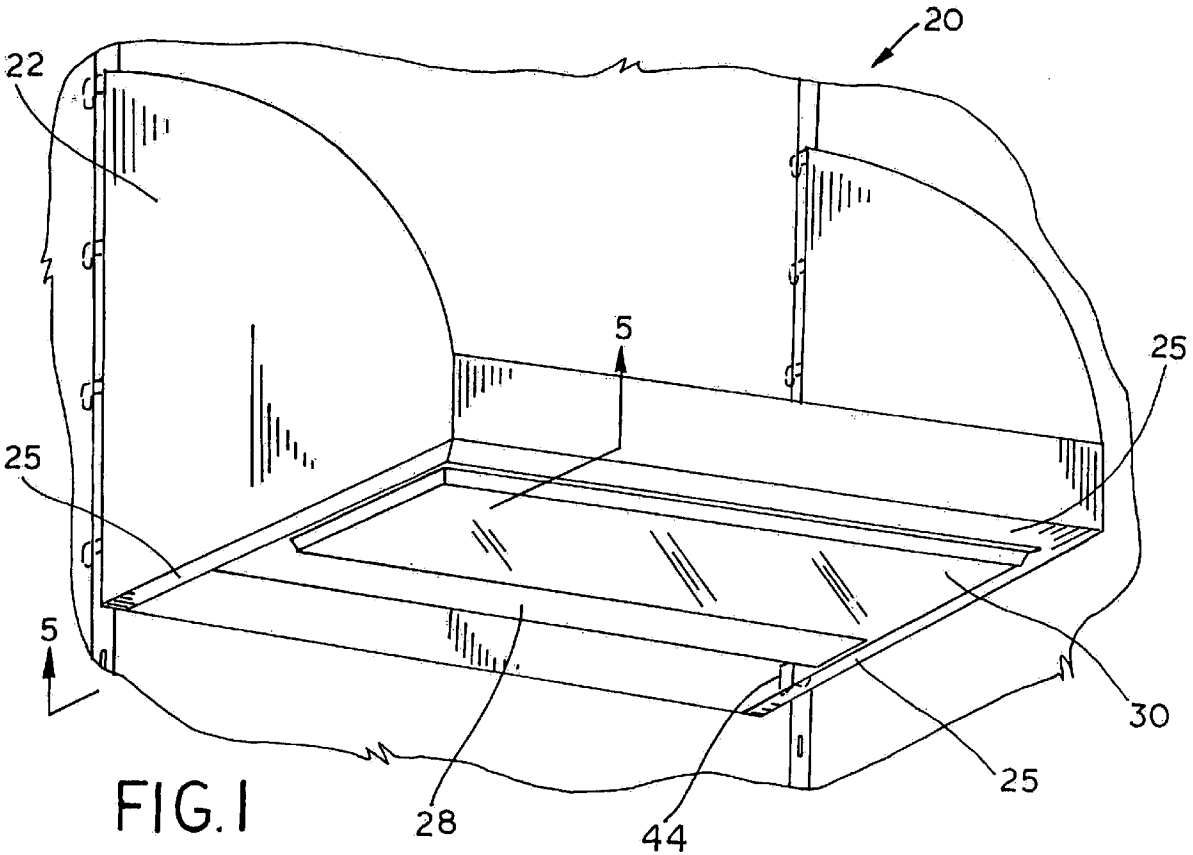
FIG. 1 is a fragmentary, perspective view of an embodiment of a furniture assembly including a light fixture according to the present invention.
Figure 2:
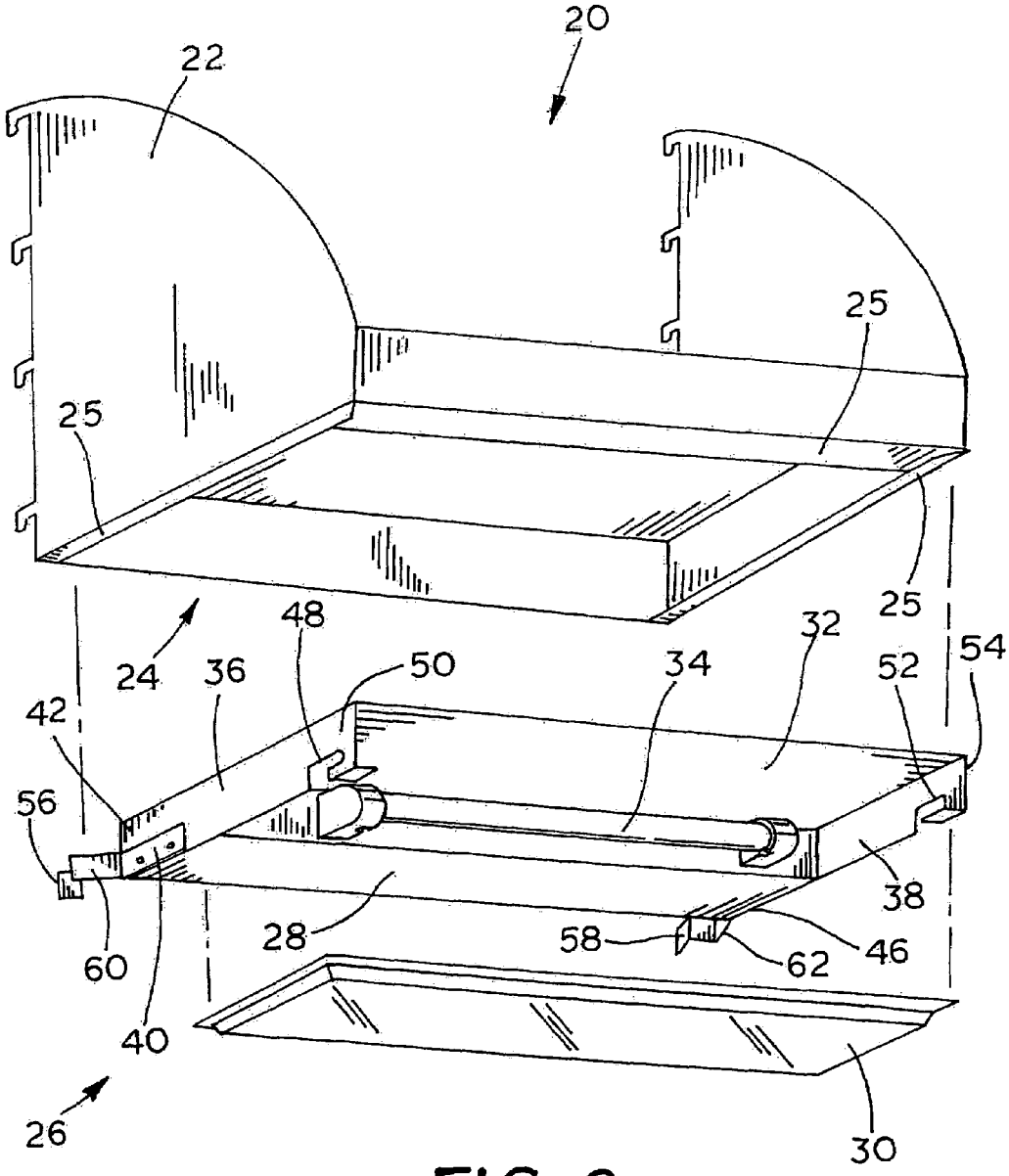
FIG. 2 is a fragmentary, exploded perspective view of the furniture assembly of FIG. 1.

Referring now to the drawings, and more particularly to FIGS. 1 and 2, there is shown a furniture assembly 20 which generally includes a furniture element 22 with an underside 24. A light fixture 26 is mounted to underside 24 of furniture element 22.

Furniture element 22 can be a shelf, cabinet, entertainment center, modular furniture element and/or panel and the like. Underside 24 can include at least one ledge 25.

Light fixture 26 can include a housing 28, a lens or diffuser 30, a reflector 32 (which may be a part of housing 28) and a light source 34. Light fixture 26 can also include electrical wiring, ballasts, control elements such as on/off switches and the like, and other elements as are known in the art. Light source 34 can be fluorescent, incandescent, light emitting diode or array thereof, sodium, high intensity discharge, xenon and/or other type of light source or combination thereof.

Housing 28 includes a first side 36 and a second side 38 opposed to and approximately parallel with first side 36. First side 36 has a first spring latch 40 at one end 42 of first side 36. Second side 38 has a second spring latch 44 at one end 46 of second side 38. Light source 34 is carried by housing 28. The spring latches can be connected to housing 28 via suitable fasteners such as rivets or screws, or can be integral with housing 28.

Figure 3:
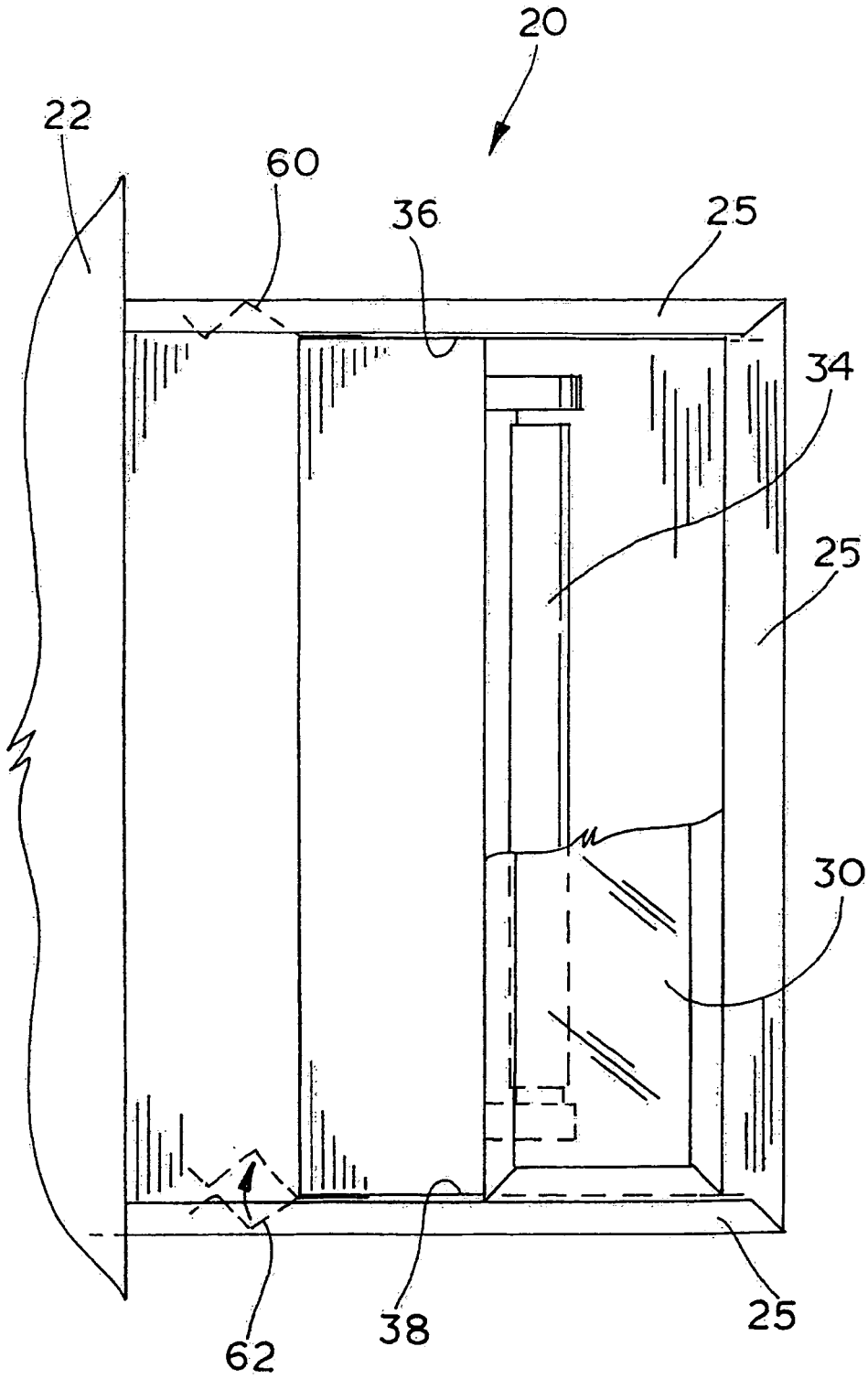
FIG. 3 is a fragmentary, bottom view of the furniture assembly of FIG. 1.
Figure 4:
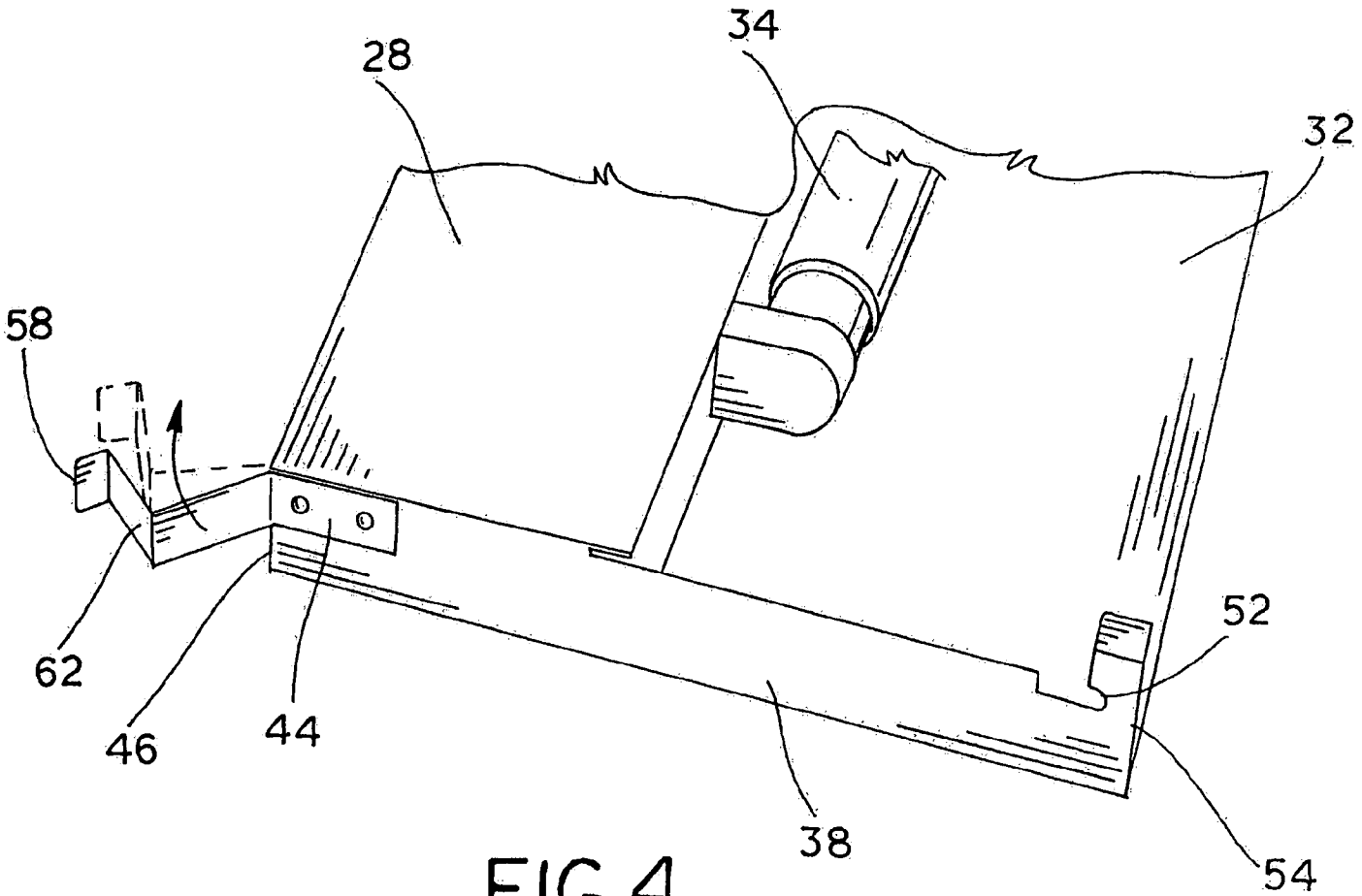
FIG. 4 is a fragmentary perspective view of the light fixture of FIG. 1, showing particularly the spring latch detail.
Figure 5:
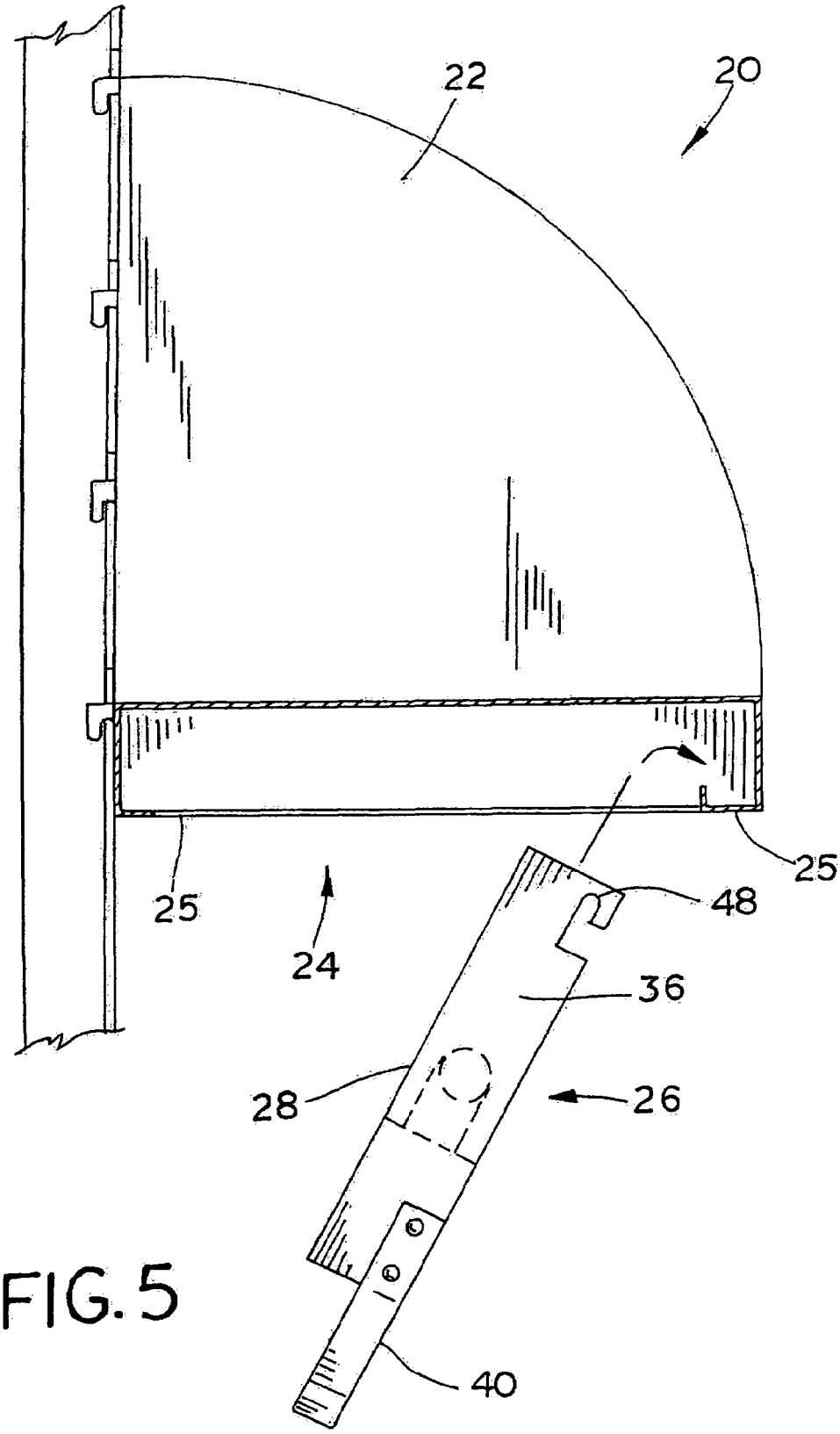
FIGS. 5-8 are partially cross-sectional, exploded side views taken along section line 5-5 in FIG. 1, showing the sequence of mounting the light fixture to the furniture assembly.
Figure 6:
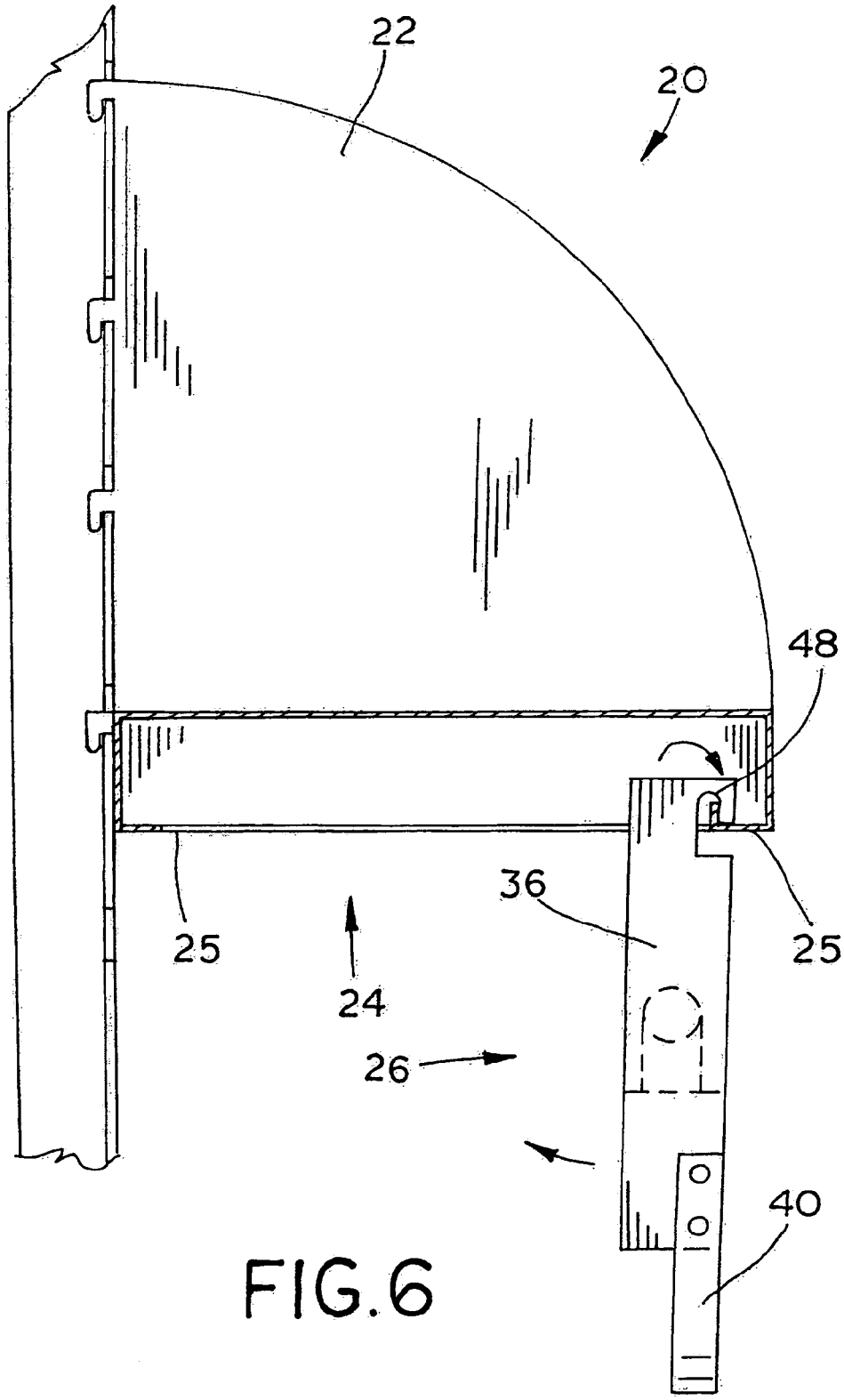
Figure 7:
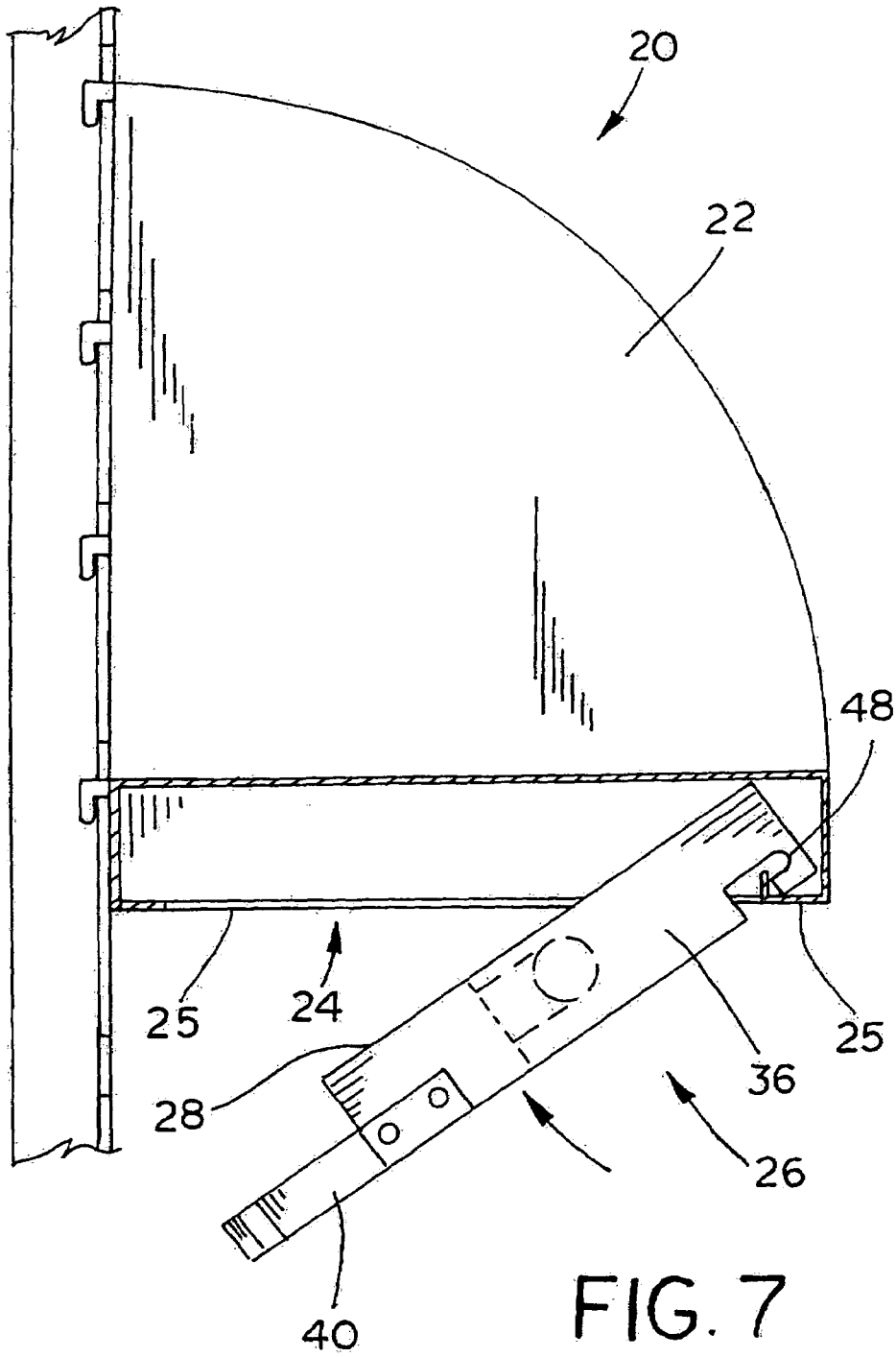
Figure 8:
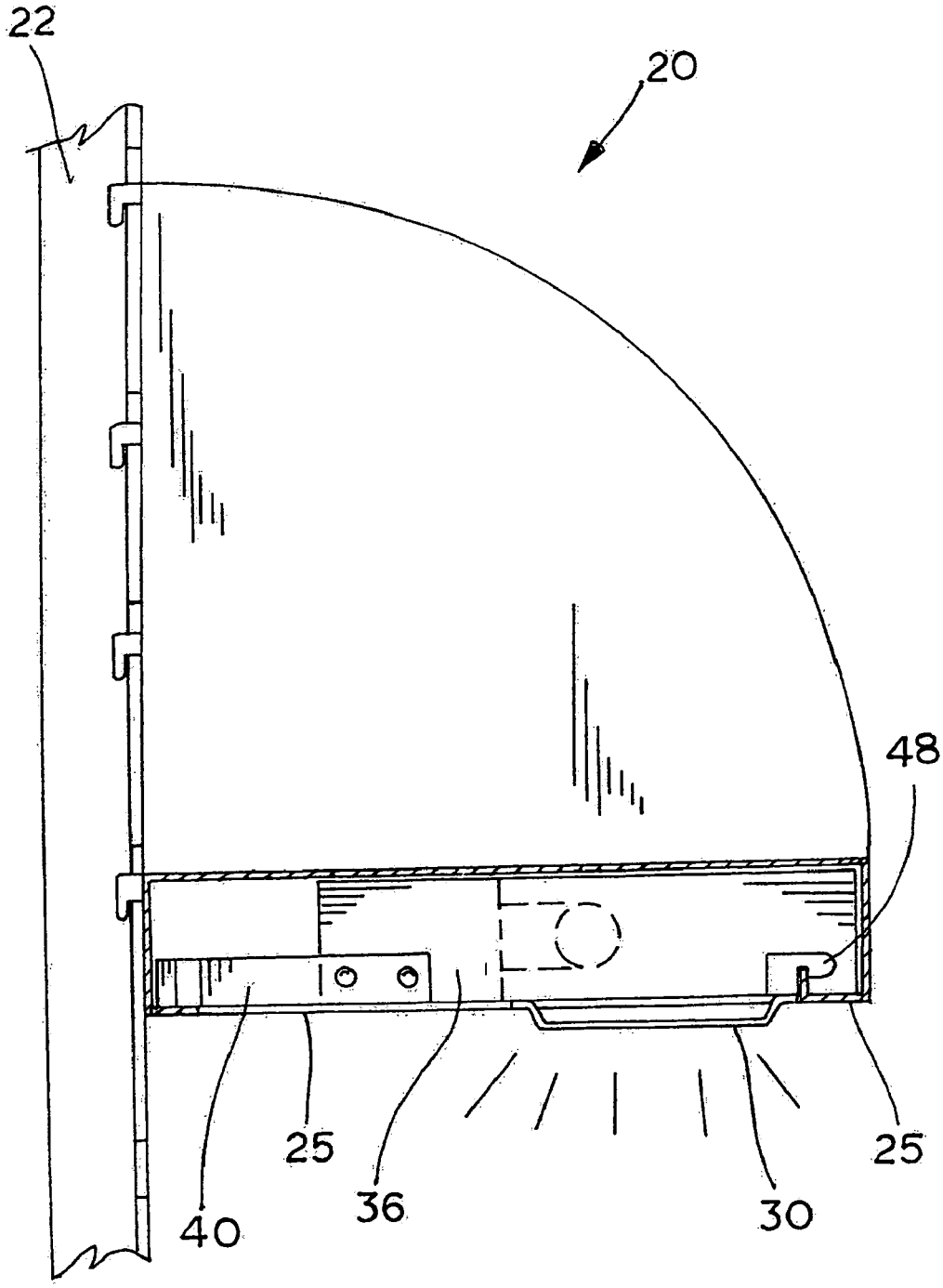
Figure 9:
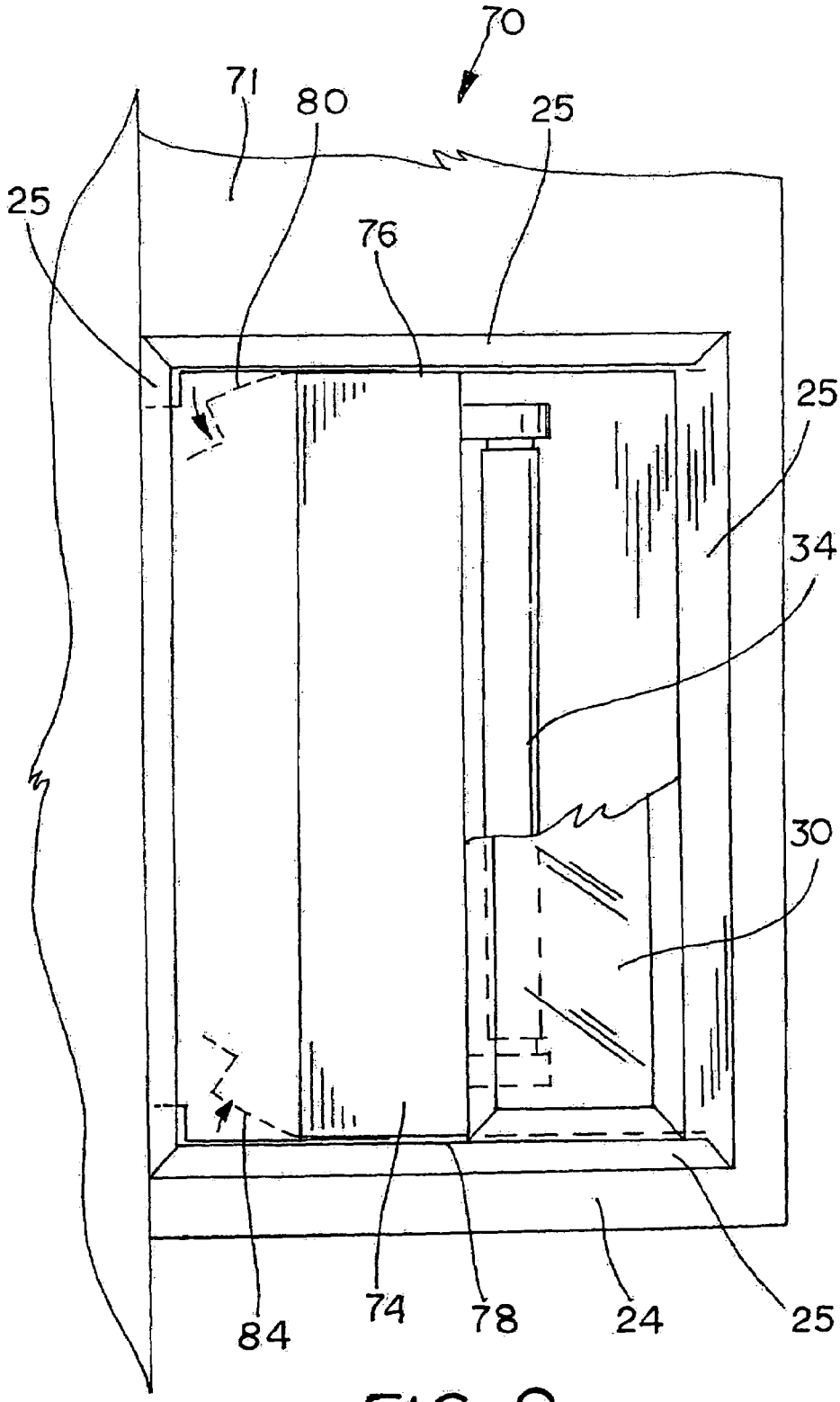
FIG. 9 is a fragmentary, bottom view of another embodiment of a furniture assembly including another light fixture according to the present invention.
Figure 10:
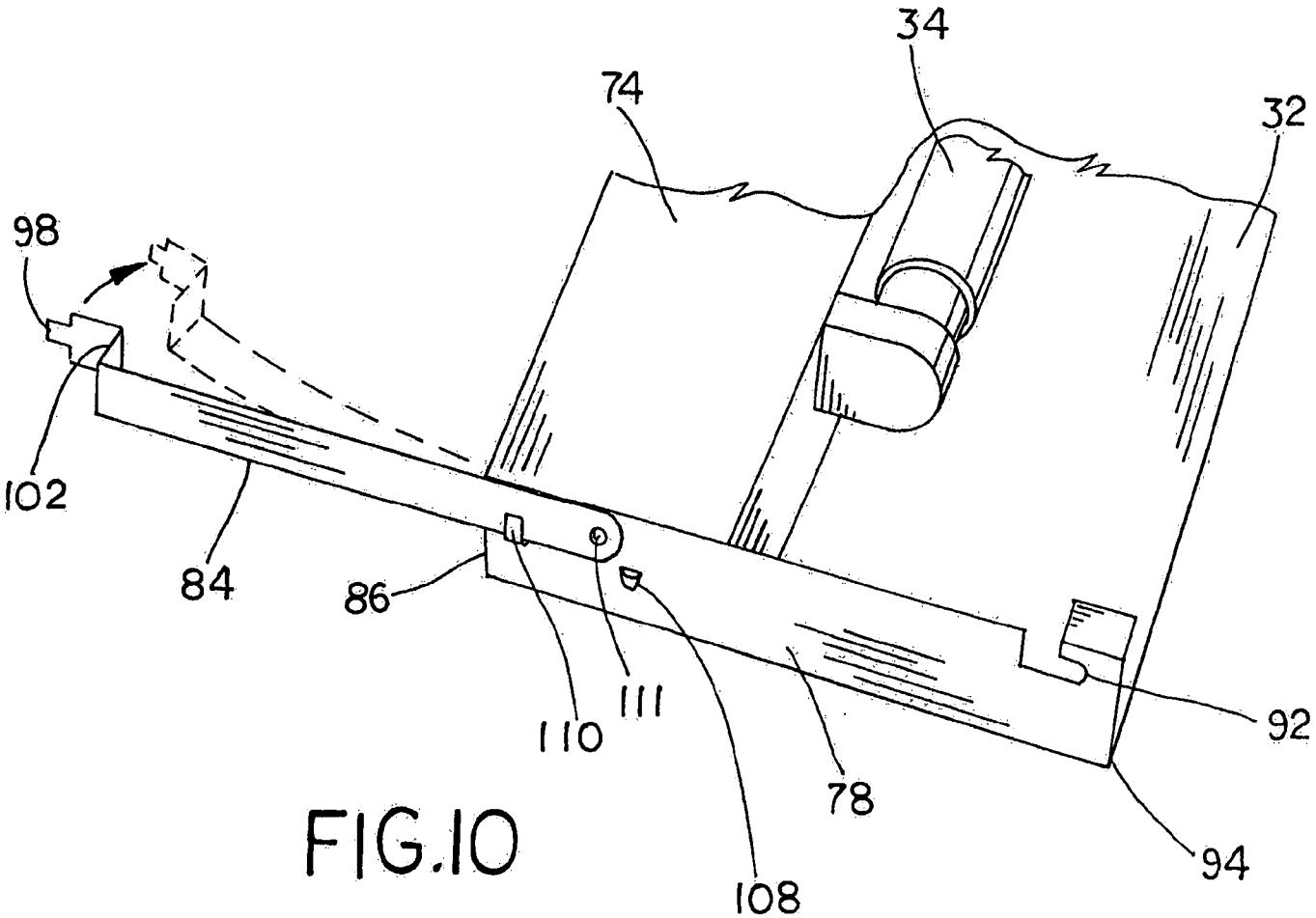
FIG. 10 is a fragmentary perspective view of the light fixture of FIG. 9, showing particularly another spring latch detail.
Figure 11:
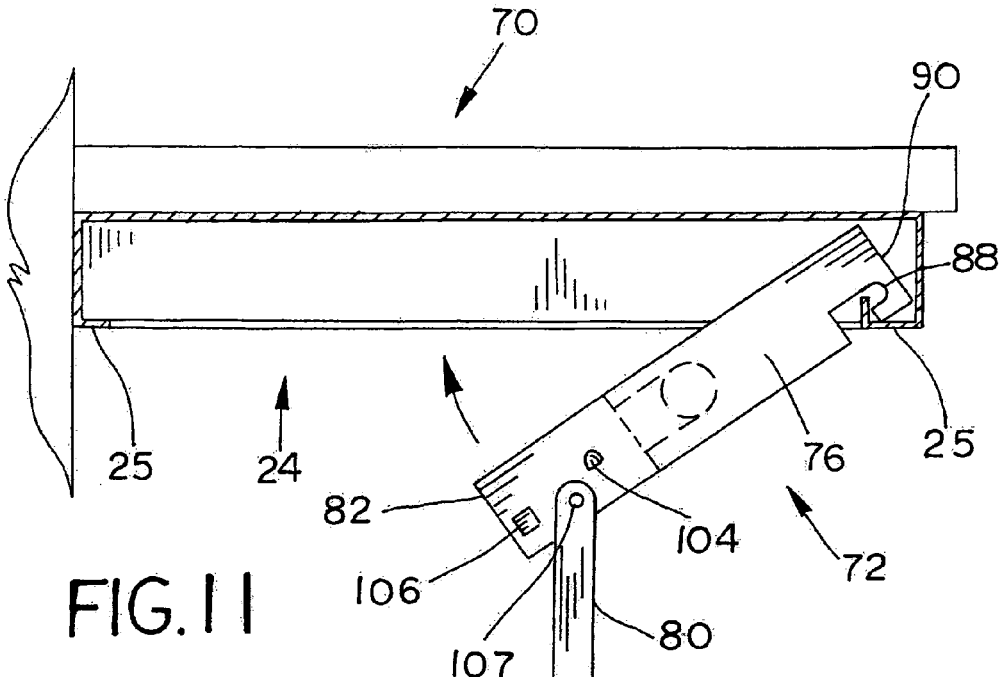
FIGS. 11 and 12 are partially cross-sectional, exploded side views of the furniture assembly of FIG. 9, showing a sequence of mounting the light fixture to the furniture assembly.
Figure 12:
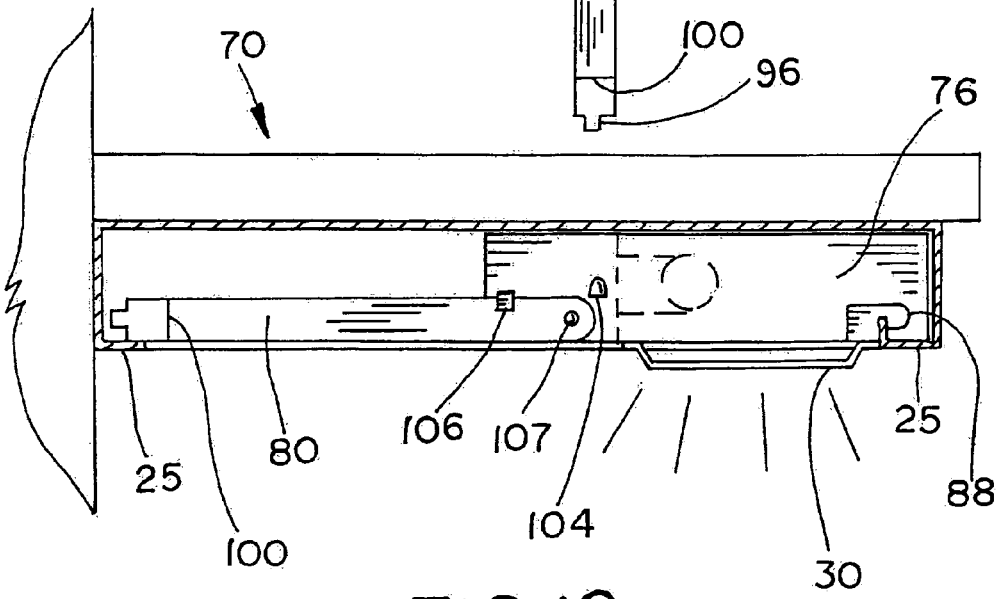
Figure 13:
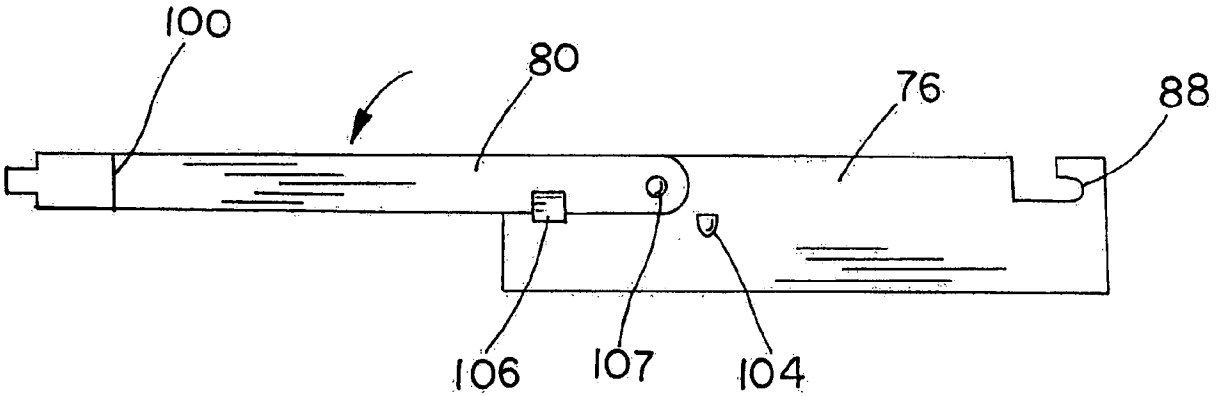
FIG. 13 is a side view of the light fixture of FIG. 9, showing particularly the spring latch when the light fixture is in a mounted position.
Figure 14:
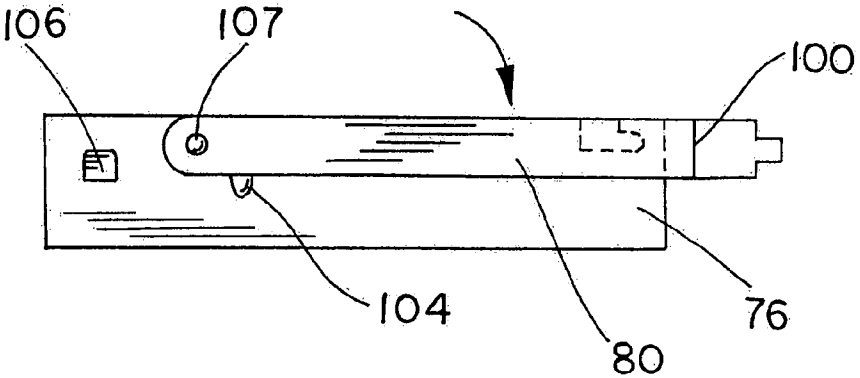
FIG. 14 is a side view of the light fixture of FIG. 17, showing particularly the spring latch in a shipping position.

First side 36 can include a first hook 48 at an opposite end 50 of first side 36. Second side 38 can include a second hook 52 at an opposite end 54 of second side 38. First spring latch 40 can include a first portion 56 which extends from end 42 of first side 36, and second spring latch 44 can include a second portion 58 which extends from end 46 of second side 38. As shown particularly in FIGS. 3 and 4, first portion 56 is resiliently deformable inwardly of first side 36, and second portion 58 is resiliently deformable inwardly of second side 38. First portion can include a first bend 60 outward of first side 36, and second portion 58 can include a second bend 62 outward of second side 38.

In use, the present invention discloses a method (FIGS. 5-8) of assembling light fixture 26 to furniture assembly 20, including the steps of: providing furniture element 22 including underside 24 with at least one ledge 25; providing light fixture 26 including: housing 28 having first side 36 and second side 38 opposed to and approximately parallel with first side 36, first side 36 having first spring latch 40 at one end 42 of first side 36 and second side 38 having second spring latch 44 at one end 46 of second side 38, and light source 34 carried by housing 28, first side 36 including first hook 48 at an opposite end 50 of first side 36, second side 38 including second hook 52 at an opposite end 54 of second side 38; hooking first hook 48 and second hook 52 to furniture element 22; rotating light fixture 26 toward underside 24; resiliently deforming inwardly both first spring latch 40 and second spring latch 44; releasing first spring latch 40 and second spring latch 44; and resting both first spring latch 40 and second spring latch 44 on a respective ledge 25.

In another embodiment (FIGS. 9-14), furniture assembly 70 includes furniture element 71 with light fixture 72 attached thereto and is otherwise similar to furniture assembly 20. Furniture element 71 includes an underside 24 with at least one ledge 25.

Similar to light fixture 26, light fixture 72 can include a housing 74, a lens 30, a reflector 32 (which may be a part of housing 74) and a light source 34. Light fixture 72 can also include electrical wiring, ballasts, control elements such as on/off switches and the like, and other elements as are known in the art.

Housing 74 includes a first side 76 and a second side 78 opposed to and approximately parallel with first side 76. First side 76 has a first spring latch 80 at one end 82 of first side 76. Second side 78 has a second spring latch 84 at one end 86 of second side 78. Light source 34 is carried by housing 74. First side 76 can include a first hook 88 at an opposite end 90 of first side 76. Second side 78 can include a second hook 92 at an opposite end 94 of second side 78. First spring latch 80 can include a first portion 96 which extends from end 82 of first side 76, and second spring latch can include a second portion 84 which extends from end 86 of second side 78. As shown particularly in FIGS. 9 and 10, first portion 96 is resiliently deformable inwardly of first side 76, and second portion 98 is resiliently deformable inwardly of second side 78. First portion can include a first bend 100 inward of first side 76, and second portion 98 can include a second bend 102 inward of second side 78.

Whereas the spring latches 40, 44 of light fixture 26 rests on side ledges 25 of underside 24, spring latches 80, 84 of light fixture 72 rests on rear ledge 25 of underside 24. In general, either light fixture 26 or light fixture 72 can be mounted in anyone of four orientations relative to underside 24.

First side 76 includes a first stop 104 and second stop or catch 106, and first spring latch 80 is pivotable relative to first side 76 at pivot point 107. First spring latch 80 engages first stop 104 when first spring latch 80 is in a shipping position, and first spring latch 80 engages second stop 106 when first spring latch 80 is in a mounted position. Similarly, second side 78 includes a third stop 108 and fourth stop or catch 110, and second spring latch 84 is pivotable relative to second side 78 at pivot point 111. Second spring latch 84 engages third stop 108 when second spring latch 84 is in a shipping position, and second spring latch 84 engages fourth stop 110 when second spring latch 84 is in a mounted position.

Figure 15:
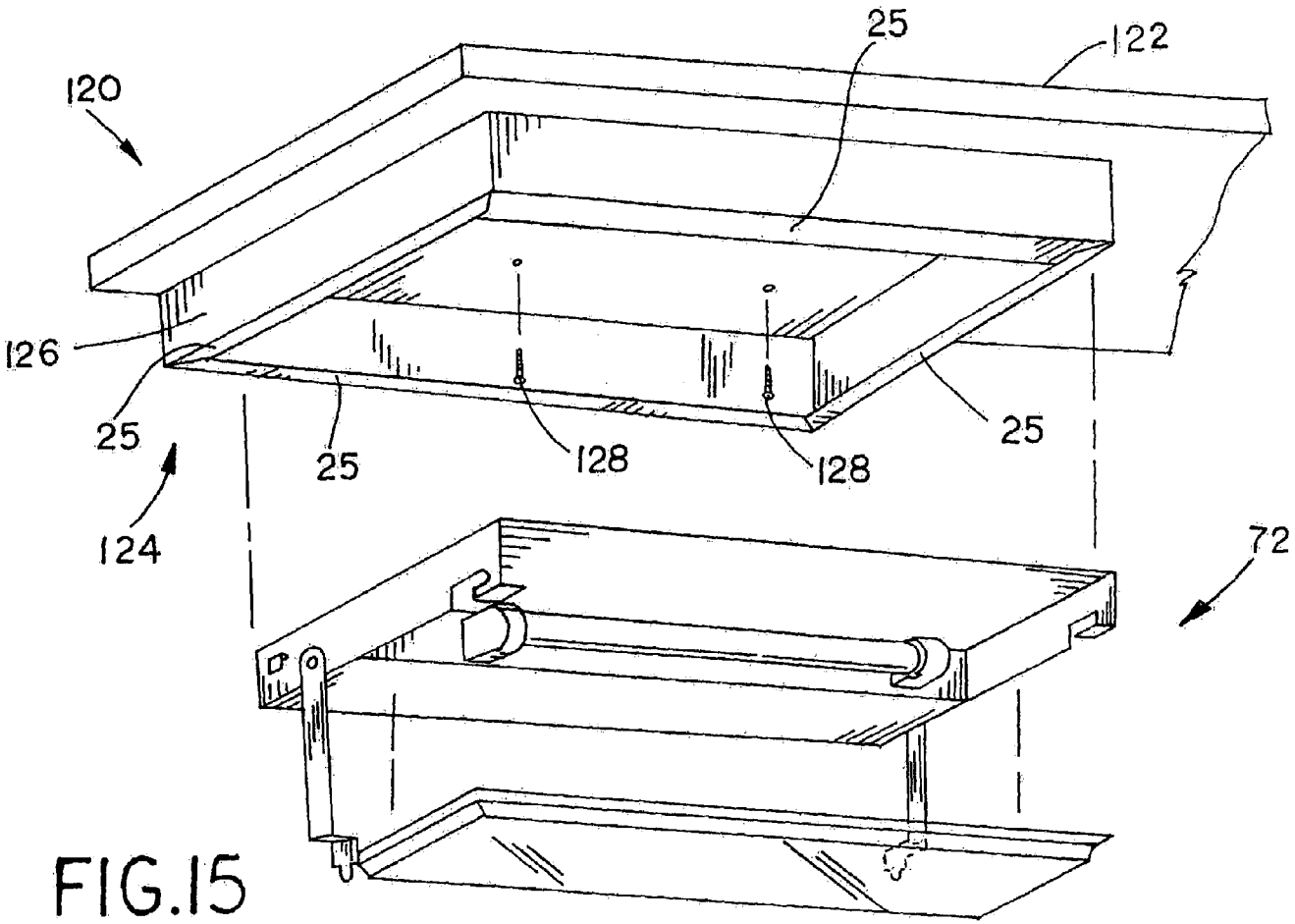
FIG. 15 is a fragmentary, exploded perspective view of a furniture assembly showing how a light fixture of the present invention can be adapted to a shelf by an open-faced box frame.
Figure 16:
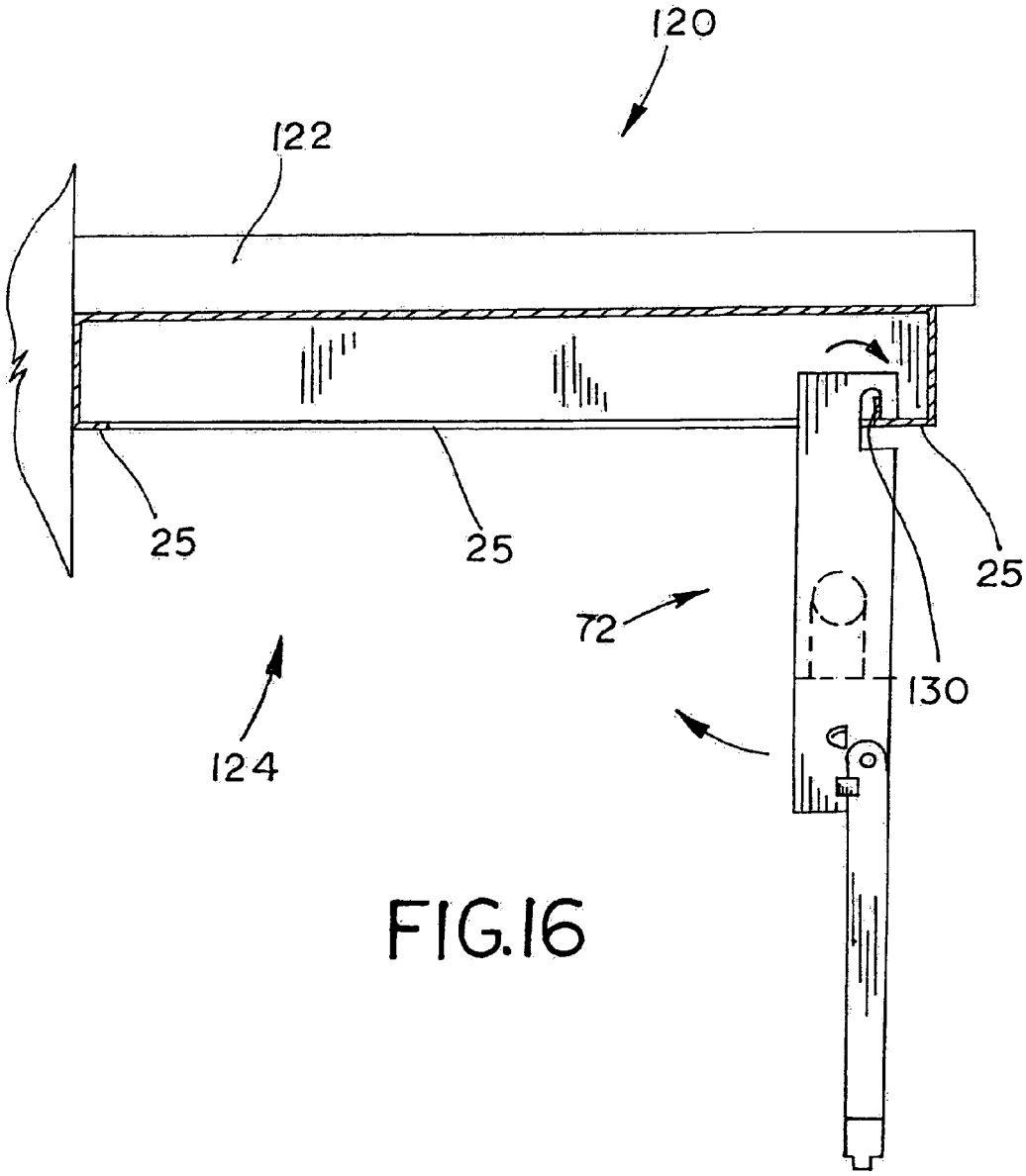
FIG. 16 is a fragmentary, partially cross-sectional side view of the assembly of FIG. 15.

FIGS. 15 and 16 show how a light fixture according to the present invention can be adapted to a furniture assembly which may not be originally configured for the light fixture. Furniture assembly 120 includes a furniture element 122 with an underside 124 which includes an open-faced box frame 126 connected thereto with fasteners 128. Frame 126 can include at least one ledge 25. Either light fixture 26 or 72 can connect to frame 126 at tab 130, which may extend to either side of frame 126, or alternatively, may include two tabs 130 at either side of frame 126

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A light fixture for mounting to the underside of a furniture element, said light fixture comprising:

a housing including a first side and a second side opposed to and approximately parallel with said first side, said first side having a first spring latch at one end of said first side and said second side having a second spring latch at one end of said second side, both said first spring latch and said second spring latch being of a cantilever construct, each extending generally away from and in line with a corresponding side edge of said housing, said first spring latch and said second spring latch not entering any portion of said housing, said first spring latch and said second spring latch each having a first bend in one direction and a second bend in an opposite direction apart from said first bend; and a light source carried by said housing.

2. The light fixture of claim 1, wherein said first side includes a first hook at an opposite end of said first side.

3. The light fixture of claim 2, wherein said second side includes a second hook at an opposite end of said second side.

4. The light fixture of claim 1, wherein said first spring latch includes a first portion which extends from said one end of said first side, and said second spring latch includes a second portion which extends from said one end of said second side.

5. The light fixture of claim 4 wherein said first portion is resiliently deformable inwardly of said first side, and said second portion is resiliently deformable inwardly of said second side.

6. The light fixture of claim 5, wherein said first portion includes a first bend outward of said first side, said second portion includes a second bend outward of said second side.

7. The light fixture of claim 5, wherein said first portion includes a first bend inward of said first side, said second portion includes a second bend inward of said second side.

8. The light fixture of claim 7, wherein said first side includes a first stop, said first spring latch is pivotable relative to said first side, said first spring latch engages said first stop when said first spring latch is in a shipping position.

9. A furniture assembly, comprising:

a furniture element including an underside; and a light fixture mounted to said underside of said furniture element, said light fixture including:

a housing including a first side and a second side opposed to and approximately parallel with said first side, said first side having a first spring latch at one end of said first side and said second side having a second spring latch at one end of said second side, both said first spring latch and said second spring latch being of a cantilever construct, each extending generally away from and in line with a corresponding side edge of said housing, said first spring latch and said second spring latch each being attached to an outside surface of said housing and not extending inside of said housing, said first spring latch and said second spring latch each having a first bend in one direction and a second bend in an opposite direction apart from said first bend; and a light source carried by said housing.

10. The furniture assembly of claim 9, wherein said first side includes a first hook at an opposite end of said first side.

11. The furniture assembly of claim 10, wherein said second side includes a second hook at an opposite end of said second side.

12. The furniture assembly of claim 9, wherein said first spring latch includes a first portion which extends from said one end of said first side, and said second spring latch includes a second portion which extends from said one end of said second side.

13. The furniture assembly of claim 12, wherein said first portion is resiliently deformable inwardly of said first side, and said second portion is resiliently deformable inwardly of said second side.

14. The furniture assembly of claim 13 wherein said first portion includes a first bend outward of said first side, said second portion includes a second bend outward of said second side.

15. The furniture assembly of claim 13, wherein said first portion includes a first bend inward of said first side, said second portion includes a second bend inward of said second side.

16. The furniture assembly of claim 15, wherein said first side includes a first stop, said first spring latch is pivotable relative to said first side, said first spring latch engages said first stop when said first spring latch is in a shipping position.

17. The furniture assembly of claim 9, wherein said furniture element is one of a modular furniture element, a shelf, cabinet and an entertainment center.

18. A method of assembling a light fixture to a furniture assembly, comprising the steps of:

providing a furniture element including an underside with at least one ledge;

providing a light fixture including: a housing including a first side and a second side opposed to and approximately parallel with said first side, said first side having a first spring latch at one end of said first side and said second side having a second spring latch at one end of said second side, and a light source carried by said housing, said first side including a first hook at an opposite end of said first side, said second side including a second hook at an opposite end of said second side, both said first spring latch and said second spring latch being of a cantilever construct, each extending generally away from and in line with a corresponding side edge of said housing, said first spring latch and said second spring latch each being connected to said housing in a non-sliding manner, said first spring latch and said second spring latch each having a first bend in one direction and a second bend in an opposite direction apart from said first bend;

hooking said first hook and said second hook to said furniture element;

rotating said light fixture toward said underside;

resiliently deforming inwardly both said first spring latch and said second spring latch;

releasing both said first spring latch and said second spring latch; and resting both said first spring and said second spring latch on a respective said at least one ledge.

* * * * *